US011419185B2

(12) United States Patent
Oh et al.

(10) Patent No.: US 11,419,185 B2
(45) Date of Patent: Aug. 16, 2022

(54) HEATER FOR CIGARETTE-TYPE ELECTRONIC CIGARETTE DEVICE

(71) Applicant: AMOSENSE CO., LTD, Cheonan-si (KR)

(72) Inventors: Chang Woo Oh, Anseong-si (KR); Young Jun An, Cheonan-si (KR); Gil Seon Lee, Cheonan-si (KR); Jung Kyun Shin, Cheonan-si (KR)

(73) Assignee: AMOSENSE CO., LTD., Cheonan-si (KR)

( * ) Notice: Subject to any disclaimer, the term of this patent is extended or adjusted under 35 U.S.C. 154(b) by 343 days.

(21) Appl. No.: 16/498,064

(22) PCT Filed: Mar. 30, 2018

(86) PCT No.: PCT/KR2018/003764
§ 371 (c)(1),
(2) Date: Sep. 26, 2019

(87) PCT Pub. No.: WO2018/194291
PCT Pub. Date: Oct. 25, 2018

(65) Prior Publication Data

US 2020/0046028 A1 Feb. 13, 2020

(30) Foreign Application Priority Data

Apr. 18, 2017 (KR) ..... 10-2017-0050012
Mar. 29, 2018 (KR) ..... 10-2018-0036711

(51) Int. Cl.
*H05B 3/14* (2006.01)

(52) U.S. Cl.
CPC ..... *H05B 3/141* (2013.01)

(58) Field of Classification Search
CPC ..... A24F 40/51; A24F 40/53; A24F 40/57
See application file for complete search history.

(56) References Cited

U.S. PATENT DOCUMENTS

2017/0006916 A1* 1/2017 Liu ..... H05B 3/03
2017/0035109 A1* 2/2017 Liu ..... H05B 3/26
2017/0079332 A1* 3/2017 Li ..... A24F 40/51
(Continued)

FOREIGN PATENT DOCUMENTS

EP 3146857 3/2017
JP S60203851 10/1985
JP H10214675 8/1998
(Continued)

OTHER PUBLICATIONS

International Search Report—PCT/KR2018/003764 dated Nov. 16, 2018.

*Primary Examiner* — Jean F Duverne
(74) *Attorney, Agent, or Firm* — Cantor Colburn LLP

(57) ABSTRACT

Provided is a heater for a cigarette-type electronic cigarette device. A heater for a cigarette-type electronic cigarette device according to an exemplary embodiments of the present invention comprises: a support body made of a ceramic material and formed to have a hollow so as to surround a cigarette; an electrode pattern formed on one surface of the support body so as to heat the cigarette inserted into the support body when power is applied; and a cover layer which has an insulation property and covers the electrode pattern.

19 Claims, 14 Drawing Sheets

(56) References Cited

U.S. PATENT DOCUMENTS

2017/0295846 A1* 10/2017 Liu ..... F22B 1/284

FOREIGN PATENT DOCUMENTS

| | | |
|---|---|---|
| JP | 2010178730 | 8/2010 |
| JP | 2013509160 | 3/2013 |
| JP | 2013511962 | 4/2013 |
| KR | 100393327 | 10/2003 |
| KR | 20070073962 | 7/2007 |
| KR | 20120115516 | 10/2012 |
| KR | 20140116055 | 10/2014 |
| KR | 101635340 | 6/2016 |
| KR | 101667124 | 10/2016 |
| KR | 20160114743 | 10/2016 |
| KR | 101677435 | 11/2016 |
| KR | 20160130342 | 11/2016 |
| KR | 20160146528 | 12/2016 |
| KR | 20170021361 | 2/2017 |
| KR | 2020170000754 | 3/2017 |
| WO | 2016120177 | 8/2016 |

* cited by examiner

HEATER FOR CIGARETTE-TYPE ELECTRONIC CIGARETTE DEVICE

TECHNICAL FIELD

The present invention relates to a heater for an electronic cigarette device, and more particularly, to a heater for a cigarette type electronic cigarette device.

BACKGROUND ART

An electronic cigarette device includes a storage, a heater or evaporator, and a battery. Here, the storage stores a processed material or extract of a leaf tobacco containing nicotine, a nicotine-free liquid material, and the like.

The electronic cigarette device heats or vaporizes the stored processed material or extract of the leaf tobacco containing the nicotine, the nicotine-free liquid material, and the like to generate an aerosol. Accordingly, in a state in which a user holds the electronic cigarette device and inhales an aerosol generated in the electronic cigarette device through an intake of the electronic cigarette device, the aerosol may be discharged to the mouth of the user through the intake. Therefore, the user may feel a feeling similar to a smoking feeling of a real cigarette by inhaling the aerosol.

However, the conventional electronic cigarette device is a liquid type electronic cigarette device for which an undiluted nicotine solution and a liquid are separately purchased and mixed. Accordingly, since the conventional electronic cigarette device has a risk that the user may purchase the undiluted nicotine solution for use for a wrong purpose such as explosion, not for smoking, active management is urgently necessary.

To solve this problem, a cigarette type electronic cigarette device in a fumigation method in which a cigarette made of a leaf tobacco is inserted and heated has been proposed. Since the cigarette type electronic cigarette device generates vapor for smoking through a method in which a heater heats a cigarette, the cigarette type electronic cigarette device has advantages in that a misuse problem is solved and a feeling similar to a feeling of a conventional cigarette is also felt.

However, there is a problem in that the conventional cigarette type electronic cigarette device may not uniformly heat an entire cigarette or a temperature rising time of the heater is slow.

DISCLOSURE

Technical Problem

The present invention is directed to providing a heater for a cigarette type electronic cigarette device in which a heating area of a cigarette is increased and the cigarette is uniformly heated.

Also, the present invention is directed to providing a heater for a cigarette type electronic cigarette device in which an initial temperature rising time of the heater is decreased.

Technical Solution

One aspect of the present invention provides a heater for a cigarette type electronic cigarette device including: a support body formed of a ceramic material and in a hollow shape to surround a circumferential surface of a cigarette; an electrode pattern patterned on one surface of the support body to heat the cigarette inserted into the support body when power is applied thereto; and a cover layer having an insulation property and configured to cover the electrode pattern.

The heater for a cigarette type electronic cigarette device may be formed in a hollow shape by sintering a ceramic green sheet after rolling the ceramic green sheet having a plate shape.

The heater for a cigarette type electronic cigarette device may include a sensor portion disposed on the one surface of the support body and configured to measure a heating temperature.

The heater for a cigarette type electronic cigarette device may further include a main body formed of a ceramic material and in a hollow shape having a predetermined length. In this case, the support body may be disposed to surround an outer surface of a part of a total length of the main body.

Meanwhile, another aspect of the present invention provides a heater for an electronic cigarette including: a main body formed of a ceramic material and including one end portion sharply formed to be inserted into a cigarette; and a heating portion disposed to surround a circumferential surface of the main body in a part of a total length of the main body to heat the cigarette.

Here, the heating portion may include: a support body formed of a ceramic material; an electrode pattern patterned on one surface of the support body to generate heat so as to heat the cigarette inserted into the support body; and a cover layer having an insulation property and configured to cover the electrode pattern.

The heating portion may be formed by sintering the support body after rolling the support body in a ceramic green sheet state to surround the circumferential surface of the main body.

In this case, at least a part of a total length of the main body may be formed in a hollow shape or in a solid type.

The heater for a cigarette type electronic cigarette device may include a coated heat radiation layer having a high heat resistance property and applied on an exposed surface of the heater to have a predetermined thickness.

The heater for a cigarette type electronic cigarette device may include a sensor portion interposed between the main body and the heating portion and configured to measure a heating temperature of the heating portion.

Meanwhile, the above-described heater for a cigarette type electronic cigarette device may be formed for a cigarette type electronic cigarette device.

Advantageous Effects

According to the present invention, since a heating area of a cigarette can be increased and the cigarette is uniformly heated, plenty of vapor can be generated, and thus smoking satisfaction of a smoker is increased.

Since an initial temperature rising time decreases, a temperature of a heater increases to a high temperature in a short time, and thus a waiting time for smoking can be decreased.

MODES OF THE INVENTION

Figure 1:
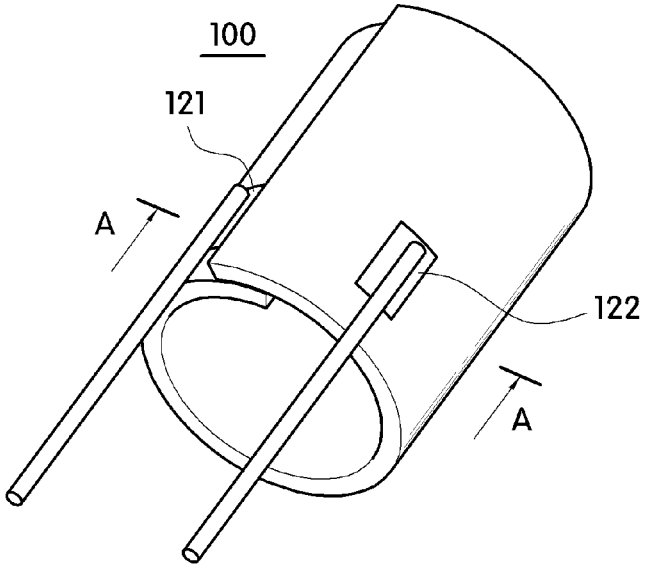
FIG. 1 is a view illustrating a heater for a cigarette type electronic cigarette device according to one embodiment of the present invention.

Hereinafter, embodiments that are easily performed by those skilled in the art will be described in detail with reference to the accompanying drawings. However, the embodiments of the present invention may be implemented in several different forms, and are not limited to the embodiments described herein. Parts irrelevant to the description are omitted in the drawings in order to clearly explain embodiments of the present invention. Similar parts are denoted by similar reference numerals throughout this specification.

Figure 24:
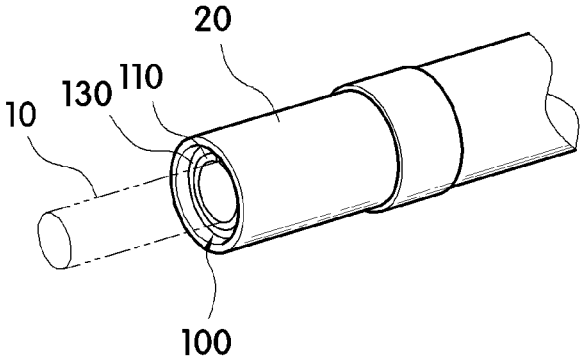
FIG. 24 is a use state view illustrating the heater for a cigarette type electronic cigarette device of FIG. 1.

As illustrated in FIG. 24, a heater 100 for a cigarette type electronic cigarette device according to one embodiment of the present invention may be installed at a side of an insertion hole 20, into which a cigarette 10 is inserted, in a cigarette type electronic cigarette device, and may be supplied with power from the cigarette type electronic cigarette device.

Accordingly, when power is applied to the heater 100 in a state in which the cigarette 10 is inserted into the insertion hole 20, the heater 100 for a cigarette type electronic cigarette device according to one embodiment of the present invention may generate heat, heat the cigarette 10 using the generated heat, and generate vapor for smoking using the cigarette 10. Therefore, a user may inhale the vapor generated from the cigarette 10 to smoke.

Here, the heater 100 for a cigarette type electronic cigarette device according to one embodiment of the present invention may be formed in a hollow shape to surround a part of a total length of the cigarette 10 inserted into the insertion hole 20.

Figure 2:
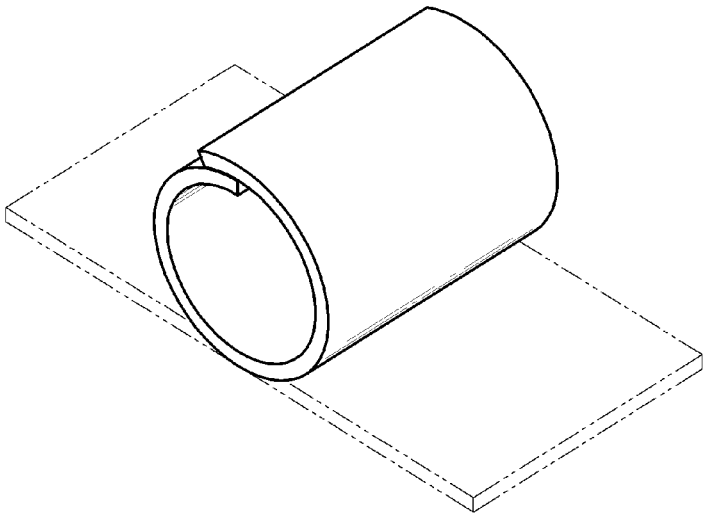
FIG. 2 is a conceptual view illustrating a process in which a heater for a cigarette type electronic cigarette device having a plate shape is changed to a heater having a cylindrical shape according to one embodiment of the present invention.

As an example, the heater 100 for a cigarette type electronic cigarette device may have a cylindrical shape with a hollow portion 101 having at least one open side as illustrated in FIGS. 1 and 2.

Accordingly, the part of the total length of the cigarette 10 may be inserted into the hollow portion 101, and a circumferential surface of the part of the cigarette 10 inserted into the hollow portion 101 may face an inner surface of the heater 100.

In addition, the circumferential surface facing the inner surface of the heater 100 may be heated by heat supplied by the heater 100 when the heater 100 generates heat.

Therefore, since the part of the cigarette 10 inserted into the hollow portion 101 may be entirely heated in a circumferential direction, a heating area may be increased. In addition, since an entire circumferential surface of the part of the cigarette 10 inserted into the hollow portion 101 faces the inner surface heater 100, an entire circumferential surface may be uniformly heated.

Here, the heater 100 for a cigarette type electronic cigarette device according to one embodiment of the present invention may include a ceramic material to improve reliability of the heater 100 and increase a life cycle thereof even under an operation condition in which an increase and a decrease in temperature are repeated and generated heat is rapidly transmitted from a heat source.

As an example, the heater 100 for a cigarette type electronic cigarette device according to one embodiment of the present invention may include a support body 110, an electrode pattern 120, and a cover layer 130, and the support body 110 may be formed of a ceramic material.

That is, the support body 110 may be formed of a ceramic material having a heat resistance property to endure in a high temperature of 100° C. or more when the electrode pattern 120 generates heat. As a non-restrictive example, the support body 110 may be a ceramic material such as alumina, $ZrO_2$, MgO, $Si_3N_4$, SiC, AlN, or ZTA, but is not limited thereto, and any known ceramic material may be used in the support body 110.

In addition, the support body 110 may have a cylindrical shape with the hollow portion 101 having at least one open side, and the electrode pattern 120 and the cover layer 130 may be disposed on one surface of the support body 110.

Figure 3:
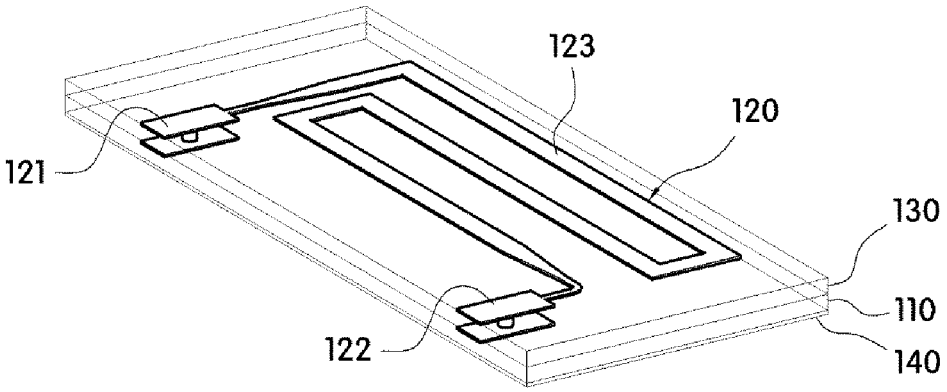
FIG. 3 is a view illustrating a detailed configuration of FIG. 2.
Figure 4:
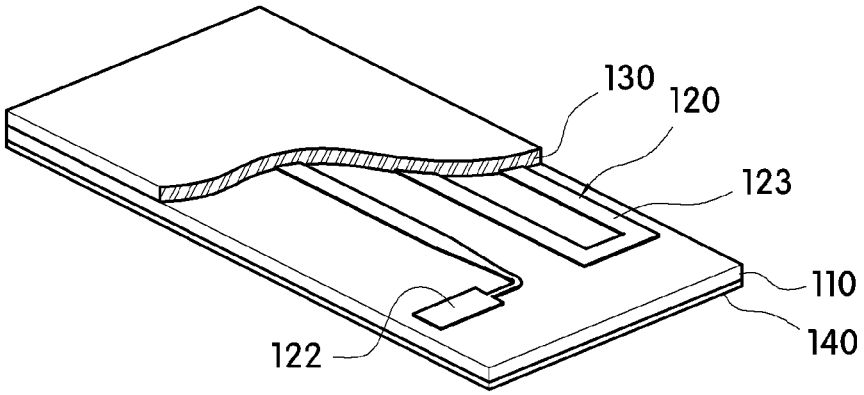
FIG. 4 is a view illustrating a state in which a part of a cover layer of FIG. 3 is cut.

To this end, as illustrated in FIGS. 3 and 4, in the heater 100 for a cigarette type electronic cigarette device according to one embodiment of the present invention, the electrode pattern 120 and the cover layer 130 may be sequentially formed on the one surface of the support body 110 having a predetermined area.

Here, the support body 110 may be a sintered ceramic green sheet, and the electrode pattern 120 and the cover layer 130 may be sequentially formed on one surface of the ceramic green sheet in a state in which the support body 110 is the ceramic green sheet.

Figure 5:
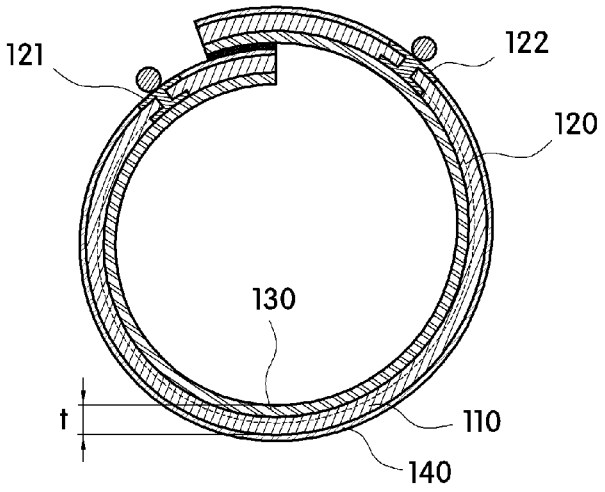
FIG. 5 is a cross-sectional view taken along line A-A of FIG. 1.

Accordingly, as illustrated in FIGS. 2 and 5, in the heater 100 for a cigarette type electronic cigarette device according to one embodiment of the present invention, one end portion of the ceramic green sheet may be rolled in one direction to be connected to and overlap a part of the other end portion thereof so that the ceramic green sheet may be changed to have a cylindrical shape with the hollow portion 101.

Here, the ceramic green sheet may be rolled such that one surface thereof on which the electrode pattern 120 and the cover layer 130 are formed is located at an inner side of the ceramic green sheet. In addition, a bonding layer may be interposed between the one end portion and other end portion of the ceramic green sheet, which overlap each other, such that unfolding of a rolled state thereof is prevented during sintering.

Next, a sintering process may be performed on the ceramic green sheet. Accordingly, since the support body 110 formed of the ceramic material is formed in the hollow cylindrical shape, the heater 100 may have the cylindrical shape with the hollow portion 101 having the at least open one side, and thus an operation for forming the heater 100 in the cylindrical shape may be very simple.

Therefore, in the heater 100 for a cigarette type electronic cigarette device according to one embodiment of the present invention, heat generated by the electrode pattern 120 when power is applied thereto is transmitted toward the support body 110 formed of the ceramic material and rapidly transmitted to an entire area of the support body 110.

Accordingly, a heating area of the heater 100 may be increased and also be entirely uniformly heated. In addition, since the support body 110 of the heater 100 is formed of the ceramic material, reliability of the heater 100 may be improved and a life cycle thereof may be increased even under an operation condition in which an increase and a decrease in temperature are repeated.

Figure 6:
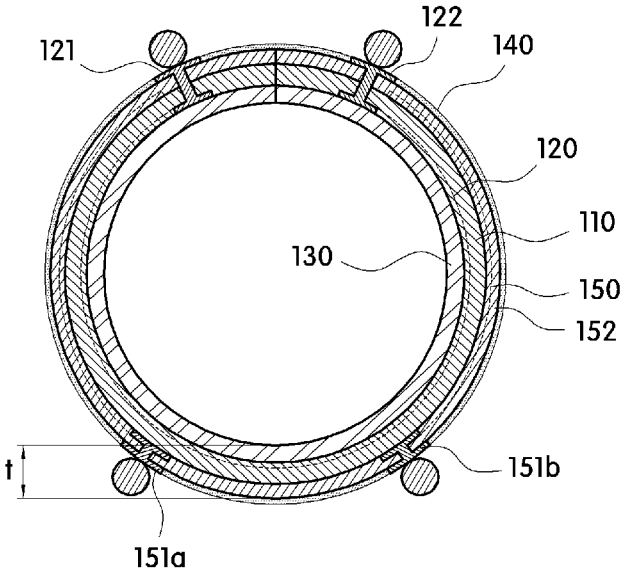
FIG. 6 is a view illustrating another form in which a sensor portion is added to FIG. 5.

Meanwhile, as illustrated in FIG. 6, a heater 100 for a cigarette type electronic cigarette device according to one embodiment of the present invention may include a sensor portion 150 disposed on one surface of a support body 110 and configured to measure a heating temperature.

The sensor portion 150 may be a thin film type temperature sensor patterned on the one surface of the support body 110.

Figure 7:
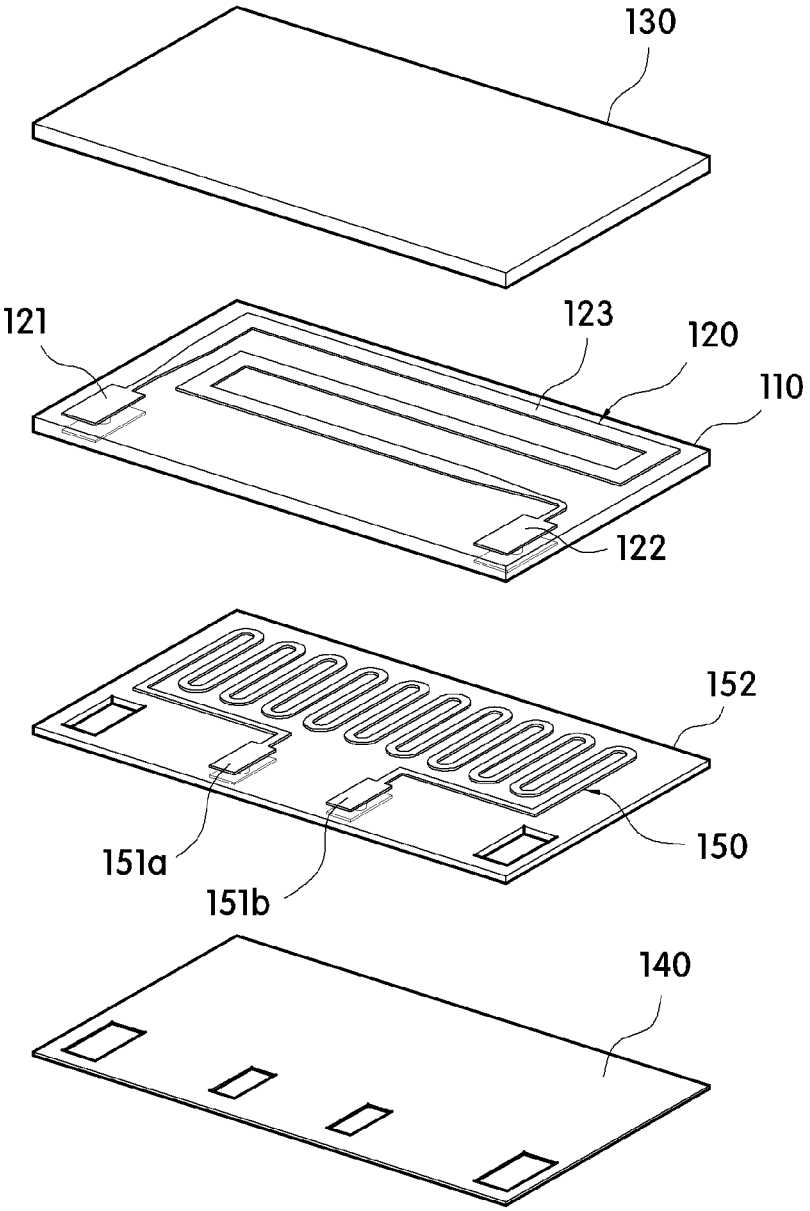
FIG. 7 is an exploded view illustrating a configuration of FIG. 6.

As an example, the sensor portion 150 may be a sensor pattern in which a conductive member is formed on one surface of a substrate 152 to have a predetermined pattern, and the substrate 152 may be a sintered ceramic green sheet. That is, as illustrated in FIG. 7, the sensor portion 150 may be patterned on the one surface of the substrate 152 in a ceramic green sheet state and stacked on the one surface of the support body 110 in a ceramic green sheet state.

Here, a material of the substrate 152 may be identical to that of the support body 110, but is not limited thereto, and any ceramic material may be used in the substrate 152. In addition, the sensor pattern may be formed to have one of various shapes like an electrode pattern 120 which will be described below.

Accordingly, the substrate 152 may be rolled with the ceramic green sheet in a process in which one end portion of the ceramic green sheet is rolled in one direction to form the support body 110 in a cylindrical shape as described above, and a shape of the sensor portion 150 may be maintained through sintering.

Therefore, the sensor portion 150 may be disposed along a circumferential surface of the support body 110 formed in the cylindrical shape and measure a temperature of an entire circumferential surface of the support body 110.

Here, a total thickness t of the heater 100 for a cigarette type electronic cigarette device according to one embodiment of the present invention may range from 0.15 to 0.8 mm. Here, in a case in which the heater 100 includes the sensor portion 150, the total thickness t may be a thickness including that of the sensor portion 150.

Accordingly, in the heater 100 for a cigarette type electronic cigarette device according to one embodiment of the present invention, although the support body 110 and the substrate 152 are formed of a ceramic material, an initial temperature rising time may be decreased.

As an example, a heating temperature of the heater 100 may be increased to 200° C. or more after power is applied to the electrode pattern 120 for 10 seconds.

This can be seen from the following Table 1.

The following Table 1 shows heating temperatures according to total thicknesses t of the heater 100 in a case in which the support body 110 and the substrate 152 are formed of alumina.

TABLE 1

| | Total Thickness (t) of Heater | | |
|---|---|---|---|
| | 200 μm | 300 μm | 400 μm |
| 0 seconds | 25.8° C. | 27.1° C. | 30.9° C. |
| After 10 seconds | 322.0° C. | 257.2° C. | 211.7° C. |
| After 15 seconds | 368.6° C. | 276.2° C. | 251.7° C. |

As seen from Table 1, in the case in which a total thickness of the heater 100 ranges from 0.2 mm to 0.4 mm, although the support body 110 and the substrate 152 are formed of the alumina, a heating temperature of the heater 100 may be increased to 200° C. or more after power is applied to the heater 100 for 10 seconds. Accordingly, in the heater 100 according to one embodiment of the present invention, since an initial temperature rising time decreases, a temperature of the heater 100 increases to a high temperature in a short time period, and thus a waiting time for smoking may be decreased. However, a total thickness of the heater 100 is not limited thereto, and may be suitably changed according to thermal conductivities of ceramic materials constituting the support body 110 and the substrate 152. The electrode pattern 120 may serve as a heating source configured to generate heat when power is applied thereto. The electrode pattern 120 may be patterned on the one surface of the support body 110 as described above.

Here, the electrode pattern 120 may be a printed pattern formed of a conductive paste, and may also have a form formed by etching the support body 110 in a state in which a conductive member is attached to the one surface of the support body 110. In addition, the electrode pattern 120 may also have a form formed by attaching a conductive member formed in a predetermined pattern through a punching method to the one surface of the support body 110.

As a non-restrictive example, each of materials of the conductive paste and/or the conductive member may be formed of any one or a combination of one or more selected from Au, Pt, Ag, tungsten, molybdenum, and manganese.

However, the material of the conductive paste is not limited thereto, and may be any known electrode material suitably selected from generally used electrode materials to generate a desired heating temperature when power is applied thereto.

The electrode pattern 120 may be formed on the one surface of the support body 110 as described above, and may be formed in a state in which the support body 110 is not sintered, that is, in a ceramic green sheet state.

In addition, as illustrated in FIG. 3, two terminals 121 and 122 for connecting other components may be formed at each of both end sides of the electrode pattern 120, and a pattern portion 123 having a predetermined length may connect the two terminals 121 and 122.

Here, the pattern portion 123 may be formed in a shape in which the pattern portion 123 is bent in a zigzag shape to be disposed on an entire area of the ceramic green sheet. Accordingly, since the heater 100 for a cigarette type electronic cigarette device according to one embodiment of the present invention may generate heat for an entire area of the support body 110 using the pattern portion 123, the heater 100 may be implemented as a surface heater.

Figure 23:
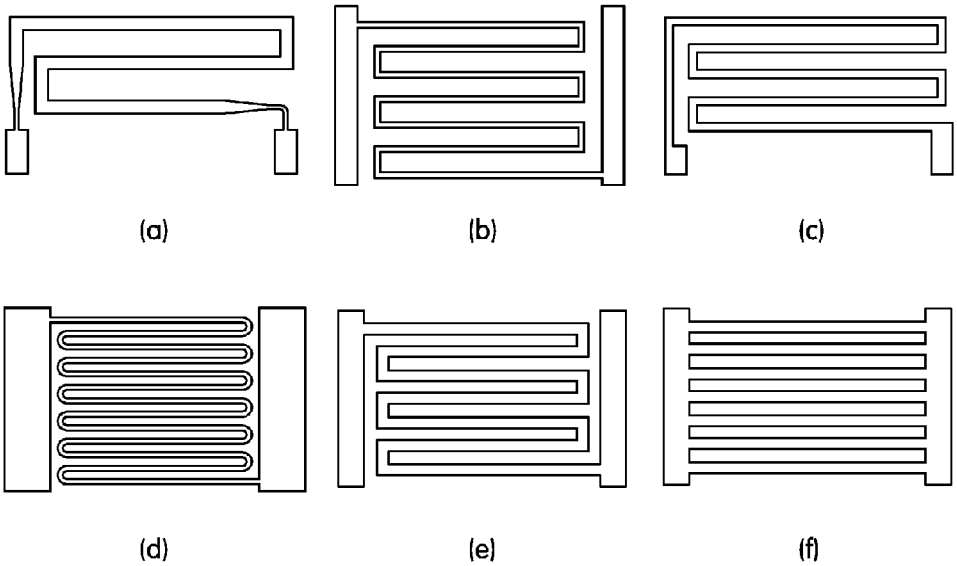
FIG. 23 is a view illustrating various shapes of electrode patterns and heater patterns applicable to the heater for a cigarette type electronic cigarette device according to one embodiment of the present invention.

However, a shape of the electrode pattern 120 is not limited thereto, and the shape of the pattern portion 123 may be suitably changed according to a design condition. As an example, the electrode pattern 120 may be formed in any one of various shapes as illustrated in FIG. 23.

In addition, the electrode pattern 120 may be formed in a serial or parallel type, or a combination of serial and parallel types. In addition, the sensor pattern constituting the sensor portion 150 may be formed in any one of various shapes as illustrated in FIG. 23, and the pattern portion 123 of the electrode pattern 120 and a pattern portion of the sensor pattern may be the same or different.

The cover layer 130 may be formed on the one surface of the support body 110 to cover the pattern portion 123 of the electrode pattern 120. Accordingly, the cover layer 130 may prevent exposure of the pattern portion 123 to the outside.

Here, the cover layer 130 may be formed of a material having an insulation property to prevent a short circuit of the electrode pattern 120 and other components. In addition, the cover layer 130 may be formed of a material having heat resistance and thermosetting properties to prevent breakdown due to heat generated by the electrode pattern 120.

As an example, the cover layer 130 may be formed of a resin having insulation, thermosetting, and heat resistance properties, and may be a coated layer applied on the one surface of the support body 110 to have a predetermined thickness.

As a specific example, the cover layer 130 may be a coated layer formed of liquid polyamide or polyamide-imide, but is not limited thereto, and any known material having insulation, thermosetting, and heat resistance properties may be used in the cover layer 130.

Meanwhile, the heater 100 for a cigarette type electronic cigarette device according to one embodiment of the present invention may include an additional protection layer 140. That is, as illustrated in FIG. 5, the protection layer 140 may be formed on an outer surface of the support body 110 exposed at the outside. Here, among both surfaces of the support body 110, the outer surface of the support body 110 may be a surface opposite the surface on which the electrode pattern 120 is formed.

The protection layer 140 may be a coated layer applied to have a predetermined thickness or may have a form formed by attaching an additional member to the outer surface of the support body 110. Accordingly, in the heater 100 for a cigarette type electronic cigarette device according to one embodiment of the present invention, although the support body 110 is formed of a ceramic material having high brittleness, since the exposed surface of the support body 110 exposed at the outside is protected by the protection layer 140, damage of the support body 110 due to an external force may be prevented. In addition, the protection layer 140 may also block heat which is generated by the electrode pattern 120 from being radiated to the outside.

Here, the two terminals 121 and 122 of the electrode pattern 120 may not be covered by the protection layer 140 to be exposed at the outside so as to be electrically connected to other components. In addition, in the case in which the heater 100 includes the sensor portion 150, two connecting terminals 151*a* and 151*b* formed on the sensor portion 150 may also not be covered by the protection layer 140 to be exposed at the outside so as to be electrically connected to other components.

To this end, the protection layer 140 may be formed of a material having at least one of heat resistance and insulation properties. As a non-restrictive example, the material of the protection layer 140 may be an epoxy resin, a urethane resin, acrylonitrile butadiene styrene (ABS), or the like, but is not limited thereto, and any known material having at least one property of heat resistance and insulation properties may be used in the protection layer 140.

Figure 8:
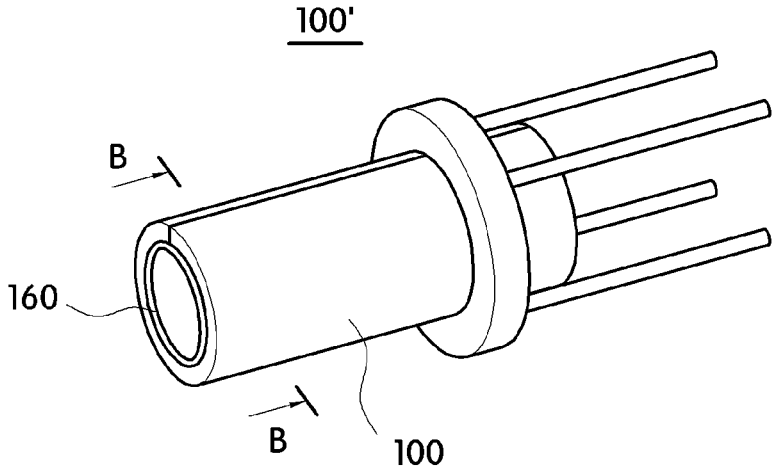
FIG. 8 is a view illustrating a modified example of FIG. 1.
Figure 9:
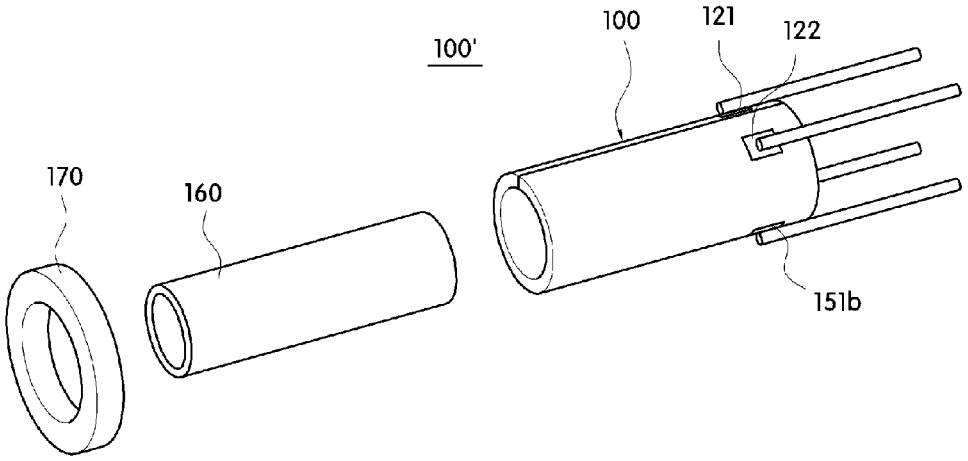
FIG. 9 is a view illustrating main parts separated from FIG. 8.
Figure 10:
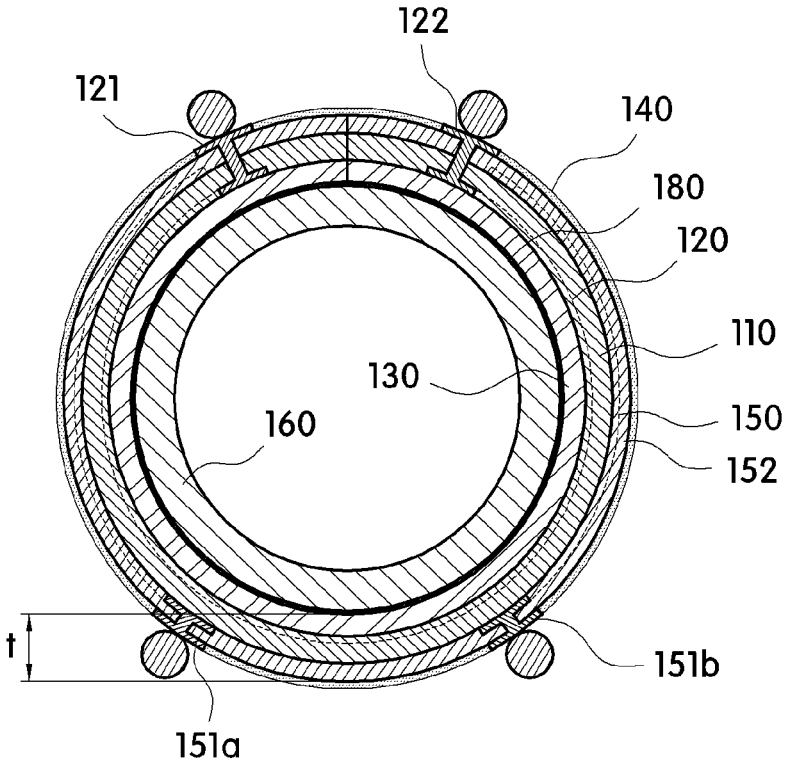
FIG. 10 is a cross-sectional view taken along line B-B of FIG. 8.
Figure 11:
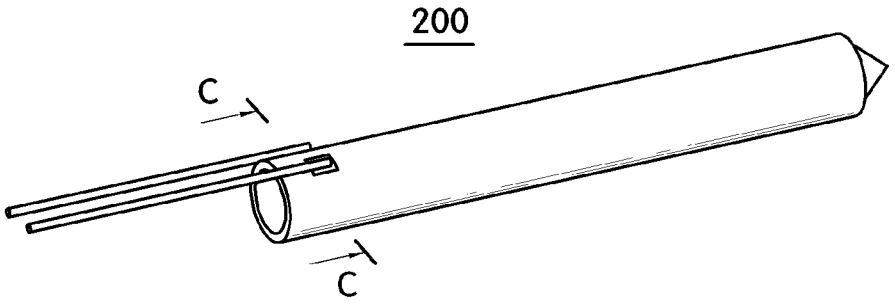
FIG. 11 is a view illustrating a heater for a cigarette type electronic cigarette device according to another embodiment of the present invention.

The heater 100' for a cigarette type electronic cigarette device according to one embodiment of the present invention may further include a main body 160 having a predetermined length and a hollow shape as illustrated in FIGS. 8 to 10. In this case, a hollow portion formed in the main body 160 may be the hollow portion 101.

As an example, the main body 160 may have a hollow cylindrical shape having a predetermined inner diameter, and the heater 100 for a cigarette type electronic cigarette device may be disposed to surround an outer surface of the main body 160 in a longitudinal direction.

In this case, one surface of a support body 110 or a cover layer 130 may be disposed to face a circumferential surface of the main body 160, and a bonding layer 180 may also be additionally interposed between the one surface of the support body 110 or one surface of the cover layer 130 and the main body 160.

In addition, in a case in which the heater 100' includes the sensor portion 150 and is disposed to surround the circumferential surface of the main body 160, terminals 121 and 122 of an electrode pattern 120 and connecting terminals 151*a* and 151*b* of sensor pattern may be formed on one surface of a protection layer 140 to be exposed at the outside.

Here, the main body 160 may be formed of a ceramic material such as alumina, $ZrO_2$, MgO, $Si_3N_4$, SiC, AlN, or ZTA like the support body 110.

Accordingly, the main body 160 may rapidly transmit heat transmitted from the support body 110 or the substrate 152 when power is applied thereto, and may uniformly heat a cigarette 10 inserted into the main body 160. In addition, reliability of the main body 160 may be improved, a life cycle thereof may be increased even under an operating condition in which an increase and a decrease in temperature are repeated, and the main body 160 may rapidly transmit heat generated by the electrode pattern 120.

In addition, since a part of the cigarette 10 inserted into the main body 160 may be entirely heated in a circumferential direction thereof, a heating area may be increased. In addition, since a circumferential surface of a part of the cigarette 10 inserted into the main body 160 faces an inner surface of the main body 160, the entire circumferential surface may be uniformly heated.

Here, a material of the main body 160 may be identical to or different from the ceramic material of the support body 110.

In this case, the main body 160 may include a sintered ceramic material, and in a state in which each of the support body 110 and the substrate 152 are in ceramic green sheet states in the heater 100 for a cigarette type electronic cigarette device, the support body 110 and the substrate 152 may be sintered after surrounding the outer surface of the main body 160.

Accordingly, the heater 100 for a cigarette type electronic cigarette device may be integrated with the main body 160 after being sintered, and although the support body 110 and the substrate 152 in the ceramic green sheet state are rolled, since the support body 110 and the substrate 152 may be supported by the completely sintered main body 160, an operation of arranging the electrode pattern 120 and a sensor pattern to surround the circumferential surface of the main body 160 may be more simple.

Meanwhile, each of the heaters 100 and 100' for a cigarette type electronic cigarette device may include a stopper 170 disposed at a side of one end portion to protrude outward in a circumferential direction. The stopper 170 may serve as a coupling member or fixing member for coupling each of the heaters 100 and 100' for a cigarette type electronic cigarette device to a cigarette type electronic cigarette device in a process of installing the each of the heaters 100 and 100' in the cigarette type electronic cigarette device.

As an example, the stopper 170 may have a ring shape in which a through hole is formed at a center portion thereof, and one end portion of the heater 100 is inserted into the through hole and may be fixed by a bonding layer.

In this case, the stopper 170 may be disposed to surround the circumferential surface of the heater 100 at a location other except for a portion on which the two terminals 121 and 122 and the connecting terminals 151*a* and 151*b* are formed.

That is, in FIG. 8, a pattern portion 123 and a pattern portion of the sensor pattern may be disposed at the left of the stopper 170, and the two terminals 121 and 122 and the connecting terminals 151*a* and 151*b* may be disposed at the right of the stopper 170.

Accordingly, in the heater 100' according to the embodiment in FIG. 8, a part of a total length of the main body 160 disposed at the left of the stopper 170 may constitute a heating region for heating the cigarette 10.

Here, the stopper 170 may be formed of a ceramic material such as alumina, $ZrO_2$, MgO, $Si_3N_4$, SiC, AlN, or ZTA to improve reliability and increase a life cycle even under an operating condition in which an increase and a decrease in temperature are repeated.

Figure 25:
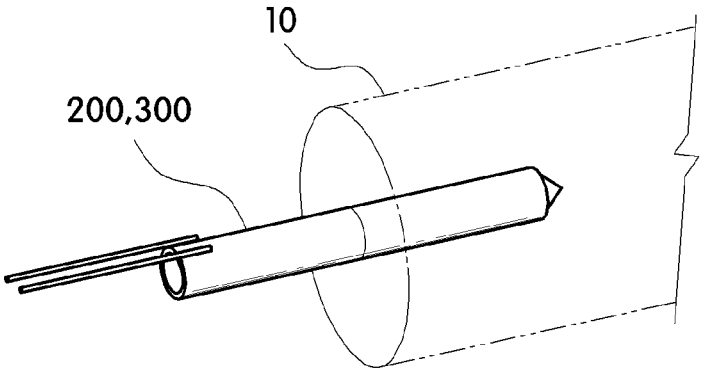
FIG. 25 is a use state view illustrating the heater for a cigarette type electronic cigarette device of FIG. 11.

Meanwhile, each of heaters 200 and 300 for a cigarette type electronic cigarette device according to another embodiment of the present invention may be formed in a needle shape having a predetermined length to be inserted into an inside of a cigarette 10 as illustrated in FIG. 25.

As an example, each of the heaters 200 and 300 for a cigarette type electronic cigarette device may include a main body 210 or 310 and a heating portion 220 as illustrated in FIGS. 11 to 20.

Here, each of the main bodies 210 and 310 may have one end portion sharply formed to be easily inserted into the inside of the cigarette 10, and the heating portion 220 may be disposed to surround a circumferential surface of each of the main bodies 210 and 310.

Accordingly, since each of the heaters 200 and 300 for a cigarette type electronic cigarette device supplies heat to the cigarette 10 through a portion inserted into the inside of the cigarette 10 to heat the inside of the cigarette 10, each of the heaters 200 and 300 may generate vapor from the cigarette 10 for smoking.

Specifically, each of the main bodies 210 and 310 may include a rod portion 211 or 311 to support the heating portion 220 and a tip portion 212 sharply formed at a side of an end portion of a rod portion 211 or 311 to be easily inserted into the inside of the cigarette 10.

Here, each of the main bodies 210 and 310 may be formed in a ceramic material. As an example, a material of each of the main bodies 210 and 310 may be a ceramic material such as alumina, $ZrO_2$, MgO, $Si_3N_4$, SiC, AlN, or ZTA, but is not limited thereto, and any known ceramic material may be used in the main bodies 210 and 310.

Accordingly, each of the main bodies 210 and 310 may quickly transmit heat generated by the heating portion 220, and reliability of each of the main bodies 210 and 310 may be improved and a life cycle thereof may increase even under an operation condition in which an increase and a decrease in temperature are repeated.

Here, in the heaters 200 and 300 for a cigarette type electronic cigarette device according to one embodiment of the present invention, although each of the main bodies 210 and 310 is formed of the ceramic material, heat generated by the heating portion 220 may be rapidly transmitted, and thus an initial temperature rising time may be decreased.

That is, a temperature of each of the heaters 200 and 300 for a cigarette type electronic cigarette device may be increased to 200° C. or more in 5 to 15 seconds when power is applied thereto, or be increased to a heating temperature of 200° C. or higher after power is applied for 10 seconds.

As an example, as illustrated in FIGS. 11 to 14, at least a part of a total length of the main body 210 may be formed in a hollow shape. The rod portion 211 of the main body 210 may preferably be formed in a hollow shape.

Accordingly, an area or volume of the main body 210 heated by heat transmitted from the heating portion 220 may be decreased. Therefore, a temperature of the heater 200 for a cigarette type electronic cigarette device according to the embodiment of the present invention may be increased to 200° C. or more in a short time period of 5 to 15 seconds when power is applied thereto.

In this case, since the rod portion 211 of the main body 210 is formed in the hollow shape, an initial temperature rising time may be decreased, and thus the above-described ceramic material, such as alumina MgO, $Si_3N_4$, SiC, AlN, zirconia, or ZTA, may be used in a material of the main body 210 without limitation.

As another example, as illustrated in FIGS. 15 to 18, both of a rod portion 311 and the tip portion 212 of the main body 310 may be formed in a solid type. In this case, each of the main bodies 210 and 310 may be formed in a material having a thermal conductivity of 30 W/m·K or more among the above-described ceramic materials. As a specific example, the main body 310 may be formed of MgO, $Si_3N_4$, SiC, AlN, or the like having the thermal conductivity of 30 W/m·K or more.

That is, since the main body 310 is formed of a cerspamic material having a relatively high thermal conductivity a temperature of the main body 310 may be rapidly increased by heat transmitted from the heating portion 220. Therefore, a temperature of the heater 300 for a cigarette type electronic cigarette device may be increased to 200° C. or more in a short time of 5 to 15 seconds after power is applied thereto, or be increased to a heating temperature of 200° C. or more after power is applied thereto for 10 seconds.

In each of the heaters 200 and 300 for a cigarette type electronic cigarette device according to one embodiment of the present invention, since a part of the main body 210 is formed in a hollow shape or the main body 310 uses a ceramic material as a material having a thermal conductivity of 30 W/m·K or more, an initial temperature rising time may decrease.

Since each of the heaters 200 and 300 for a cigarette type electronic cigarette device according to one embodiment of the present invention may decrease a time for which vapor for smoking is generated from cigarette 10, ease of use for a user may be improved by decreasing a waiting time.

The heating portion 220 may serve as a heating source configured to generate heat when power is applied thereto.

The heating portion 220 may be disposed to surround an outer surface of each of the main bodies 210 and 310. As an example, the heating portion 220 may be disposed to surround each of the rod portions 211 and 311 of the main body 210 or 310. Accordingly, heat generated by the heating portion 220 when power is applied thereto may be transmitted to a side of each of the main bodies 210 and 310. Here, a bonding layer 180 may be interposed between the heating portion 220 and each of the rod portions 211 and 311 of the main body 210 or 310.

To this end, as illustrated in FIGS. 11 to 18, the heating portion 220 may include a support body 221, an electrode pattern 222, and a cover layer 223, and the support body 221, the electrode pattern 222, and the cover layer 223 may be respectively identical to the support body 110, the electrode pattern 120, and the cover layer 130 according to the previous embodiment.

Specifically, the support body 221 may be formed of a ceramic material having a heat resistance property to endure a high temperature of 100° C. or more when the electrode pattern 222 generates heat. As a non-restrictive example, a material of the support body 221 may be a ceramic material such as alumina, ZrO2, MgO, Si3N4, SiC, AlN, or ZTA, but is not limited thereto, and any known ceramic material may be used in a material of the support body 221.

In addition, the electrode pattern 222 and the cover layer 223 may be disposed on one surface of the support body 221.

Figure 21:
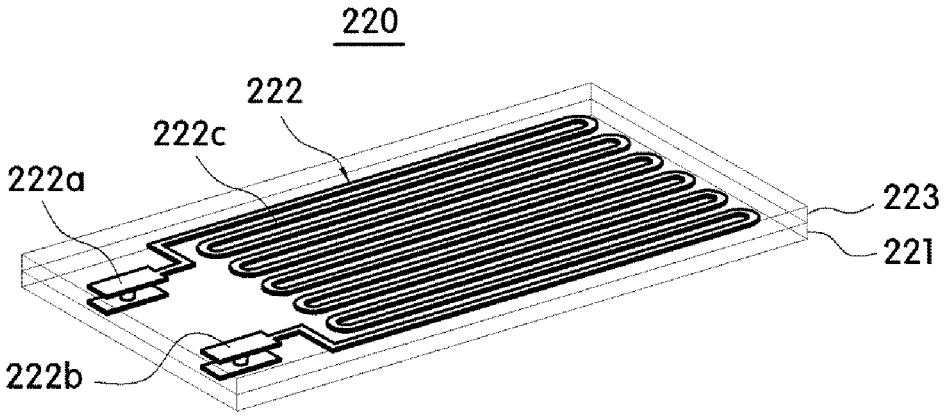
FIG. 21 is a view illustrating a detailed configuration of a heating portion applicable to FIGS. 11 to 20.
Figure 22:
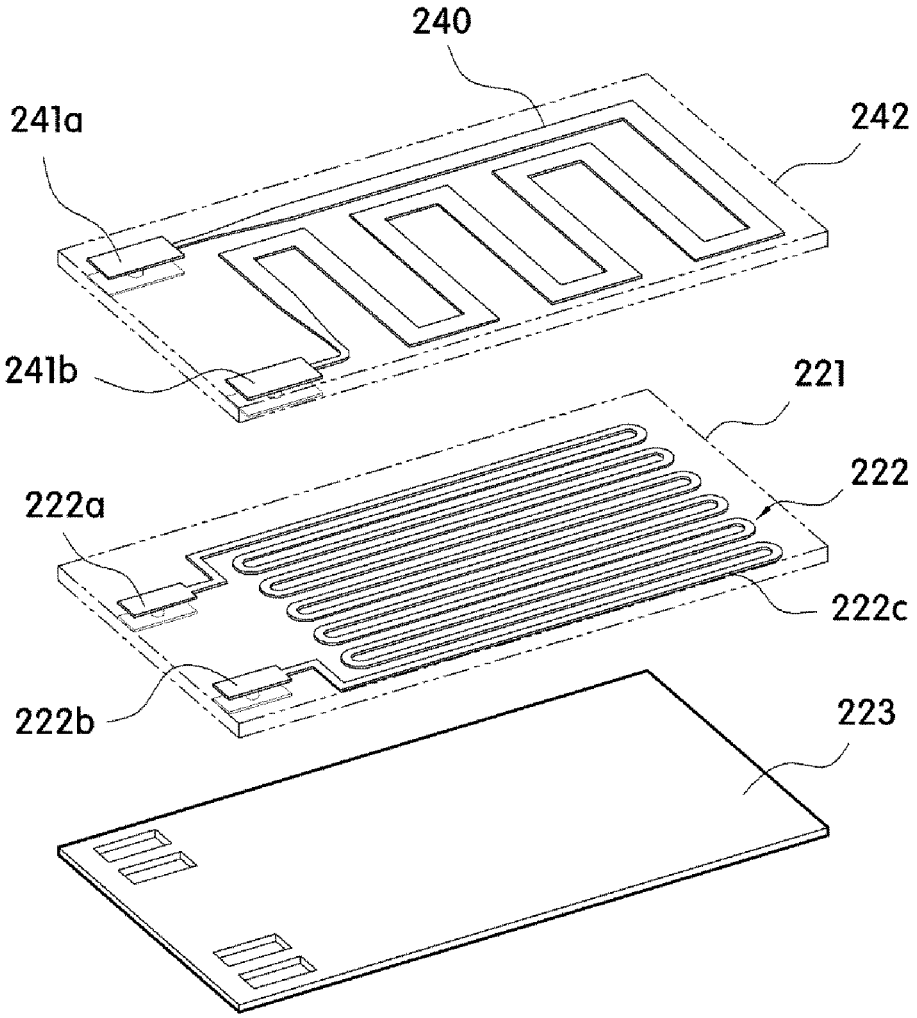
FIG. 22 is a view illustrating a configuration in which a sensor portion is added in FIG. 21.

To this end, as illustrated in FIGS. 21 and 22, in each of the heaters 200 and 300 for a cigarette type electronic cigarette device according to one embodiment of the present invention, the electrode pattern 222 and the cover layer 223 may be sequentially formed on the one surface of the support body 221 having a predetermined area.

Here, the support body 221 may be a sintered ceramic green sheet, and the electrode pattern 222 and the cover layer 223 may be sequentially formed on a ceramic green sheet in a state in which the support body 221 is the ceramic green sheet.

Accordingly, the each of the heaters 200 and 300 for a cigarette type electronic cigarette device according to one embodiment of the present invention may be disposed such that the heating portion 220 surrounds each of the rod portions 211 and 311 of the corresponding main body 210 or 310 by rolling the support body 221 in a circumferential direction of each of the rod portions 211 and 311 of the corresponding main body 210 or 310 in a state in which the support body 221 is the ceramic green sheet before being sintered.

Therefore, in the each of the heaters 200 and 300 for a cigarette type electronic cigarette device according to one embodiment of the present invention, an operation in which the heating portion 220 is disposed to surround each of the rod portions 211 and 311 may be very simply performed, and the heating portion 220 may be integrated with each of the main bodies 210 and 310 after being sintered.

Accordingly, in the each of the heaters 200 and 300 for a cigarette type electronic cigarette device according to one embodiment of the present invention, heat generated by the electrode pattern 222 when power is applied thereto may be transmitted toward each of the main bodies 210 and 310 through the support body 221.

Therefore, heating areas of the heaters 200 and 300 may be increased and also be entirely uniformly heated. In addition, in the heaters 200 and 300, since the support body 221 and the main bodies 210 and 310 are formed of a ceramic material, reliability of the heaters 200 and 300 may be improved and a life cycle thereof may be increased even under an operation condition in which an increase and a decrease in temperature are repeated.

Figure 14:
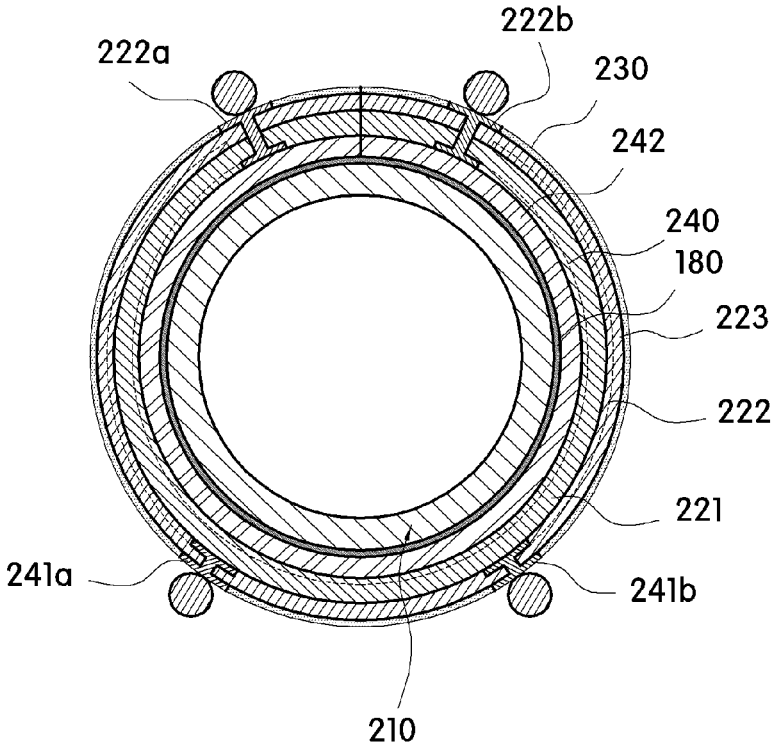
FIG. 14 is a cross-sectional view illustrating a configuration in which a sensor portion is added in FIG. 12.
Figure 15:
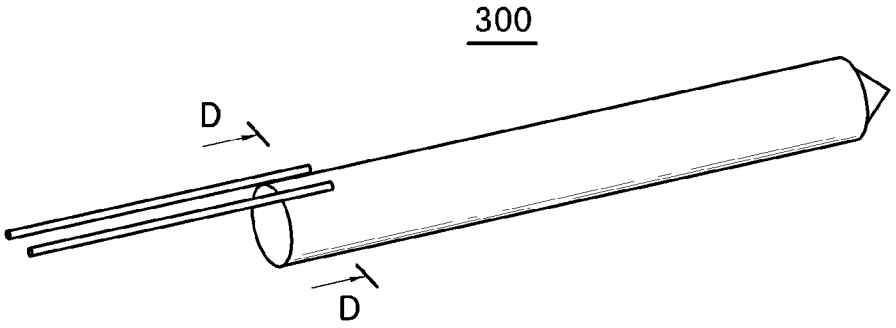
FIG. 15 is a view illustrating a heater for a cigarette type electronic cigarette device according to still another embodiment of the present invention.
Figure 18:
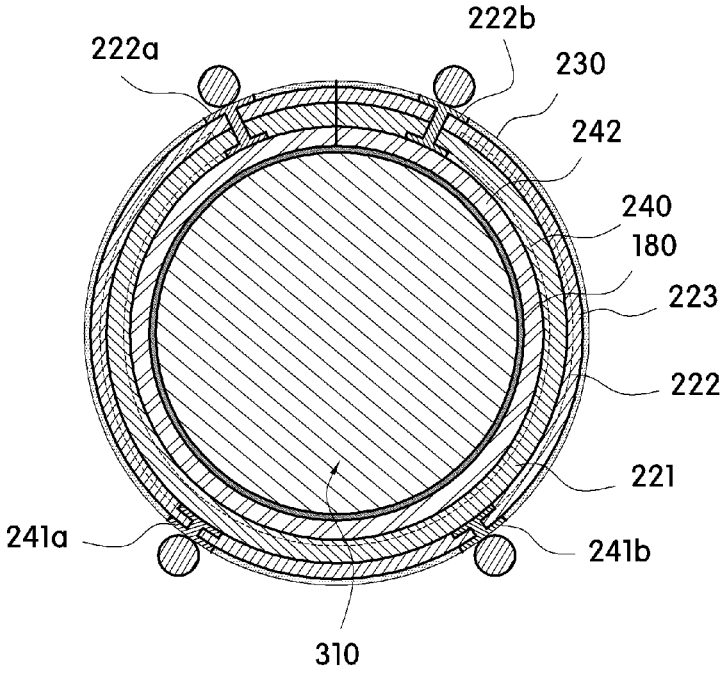
FIG. 18 is a cross-sectional view illustrating a configuration in which a sensor portion is added in FIG. 15.

Meanwhile, as illustrated in FIGS. 14 and 18, each of heaters 200 and 300 for a cigarette type electronic cigarette device according to one embodiment of the present invention may further include a sensor portion 240 disposed on one surface of a support body 221 for measuring a heating temperature.

The sensor portion 240 may be a thin film type temperature sensor patterned on the one surface of the support body 221.

As an example, the sensor portion 240 may be a sensor pattern in which a conductive member is patterned in a predetermined pattern on one surface of a substrate 242, and the substrate 242 may be a ceramic green sheet. That is, as illustrated in FIG. 22, in a state in which the sensor portion 240 is patterned on the one surface of the substrate 242 which is the ceramic green sheet, the substrate 242 may be stacked on the one surface of the support body 221 in a ceramic green sheet state.

Here, a material of the substrate 242 may be identical to that of the support body 221, but is not limited thereto, and any ceramic material may be used in the substrate 242. In addition, the sensor pattern may be formed in one of various patterns like the electrode pattern 222.

Accordingly, the sensor portion 240 may be rolled with the support body 221 in the ceramic green sheet state in a process in which the support body 221 in the ceramic green sheet state is rolled to surround each of the rod portions 211 and 311 as described above, and a shape of the sensor portion 240 may be maintained through sintering.

In this case, the sensor portion 240 may be interposed between the support body 221 and each of the rod portions 211 and 311 of the corresponding main body 210 or 310.

Therefore, the sensor portion 240 may be disposed along an inner surface of the support body 221 configured to surround each of the rod portions 211 and 311, and an overall temperature of the support body 221 and each of the main bodies 210 and 310 may be measured.

The electrode pattern 222 may serve as a heating source configured to generate heat when power is applied thereto. The electrode pattern 222 may be patterned on the one surface of the support body 221 as described above.

Here, the electrode pattern 222 may be a printed pattern formed of a conductive paste, and may also have a form formed by etching a conductive member in a state in which the conductive member is attached to the one surface of the support body 221. In addition, the electrode pattern 222 may also have a form formed by attaching a conductive member formed in a predetermined pattern through a punching method to the one surface of the support body 110.

As a non-restrictive example, a material of the conductive paste and/or the conductive member may be formed of any one or a combination of one or more selected from Au, Pt, Ag, tungsten, molybdenum, and manganese. However, the material of the conductive paste is not limited thereto, and may be any known electrode material suitably selected from generally used electrode materials to generate a desired heating temperature when power is applied thereto.

The electrode pattern 222 may be formed on the one surface of the support body 221 as described above, and may be formed in a state in which the support body 221 is not sintered, that is, a ceramic green sheet.

In addition, as illustrated in FIG. 21, two terminals 222*a* and 222*b* for connecting other components may be formed at each of both end sides of the electrode pattern 222, and a pattern portion 222*c* having a predetermined length may connect the two terminals 222*a* and 222*b*.

Here, the pattern portion 222*c* may be formed in a shape in which the pattern portion 222*c* is bent in a zigzag shape to be disposed on an entire area of the ceramic green sheet. Accordingly, since each of the heaters 200 and 300 for a cigarette type electronic cigarette device according to one embodiment of the present invention may generate heat for an entire area of the support body 221 using the pattern portion 222*c*, the heater 200 and 300 may be formed as a surface heater.

However, the shape of the electrode pattern 222 is not limited thereto, and the pattern portion 222*c* may be suitably changed according to a design condition. As an example, the electrode pattern 222 may be formed in one of various shapes as illustrated in FIG. 23.

In addition, the electrode pattern 222 may be formed in a serial or parallel type, or a combination of serial and parallel types. In addition, the sensor pattern constituting the sensor portion 240 may be formed in one of various shapes as illustrated in FIG. 23, and the shapes of the pattern portion 222*c* of the electrode pattern 222 and the pattern portion of the sensor pattern may be the same or different.

The cover layer 223 may be formed on the one surface of the support body 221 to cover the pattern portion 222*c* of the electrode pattern 222. Accordingly, the cover layer 223 may prevent exposure of the pattern portion 222*c* to the outside.

Here, the cover layer 223 may be formed of a material having an insulation property to prevent a short circuit of the electrode pattern 222 and other components. In addition, the cover layer 223 may be formed of a material having heat resistance and thermosetting properties to prevent breakdown due to heat generated by the electrode pattern 222.

As an example, the cover layer 223 may be formed of a resin having insulation, thermosetting, and heat resistance properties, and may be a coated layer applied on the one surface of the support body 221 to have a predetermined thickness.

As a specific example, the cover layer 223 may be a coated layer formed of liquid polyamide or polyamide-imide, but is not limited thereto, and any known material having insulation, thermosetting, and heat resistance properties may be used in the cover layer 223.

Figure 12:
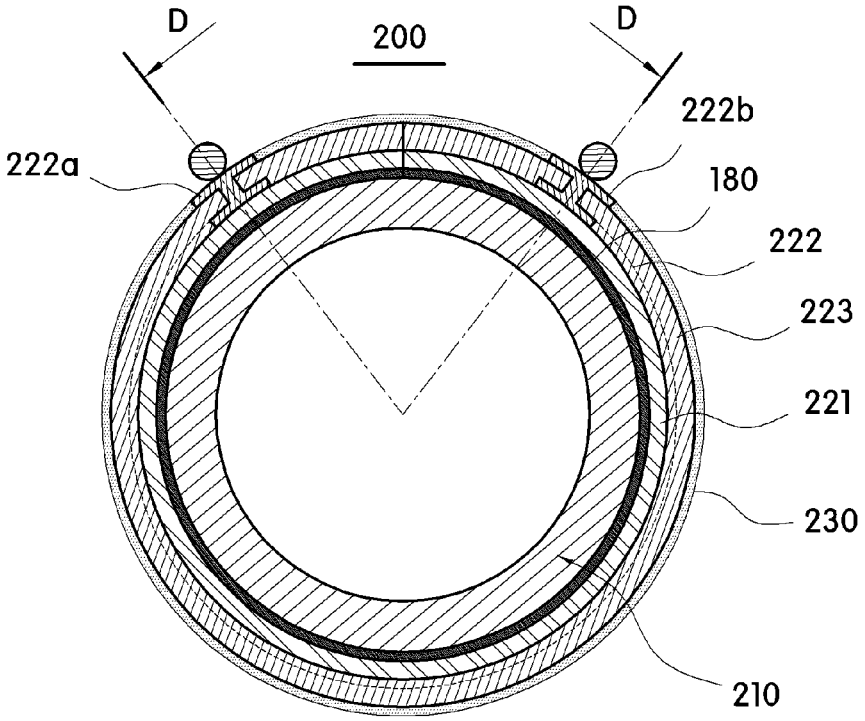
FIG. 12 is a cross-sectional view taken along line C-C of FIG. 11.
Figure 13:
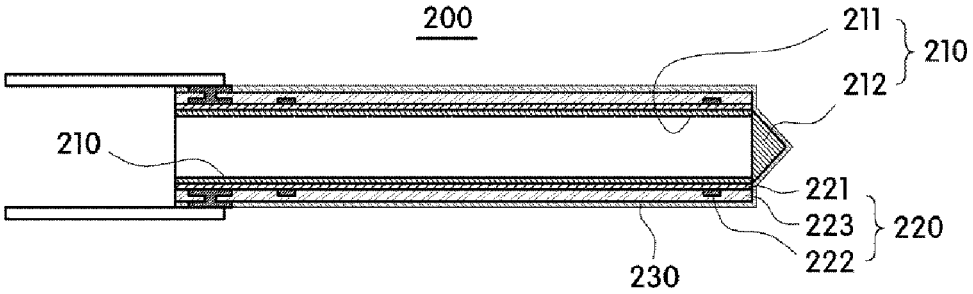
FIG. 13 is a transverse cross-sectional view of FIG. 11 when viewed in a direction of line D-D of FIG. 12.
Figure 16:
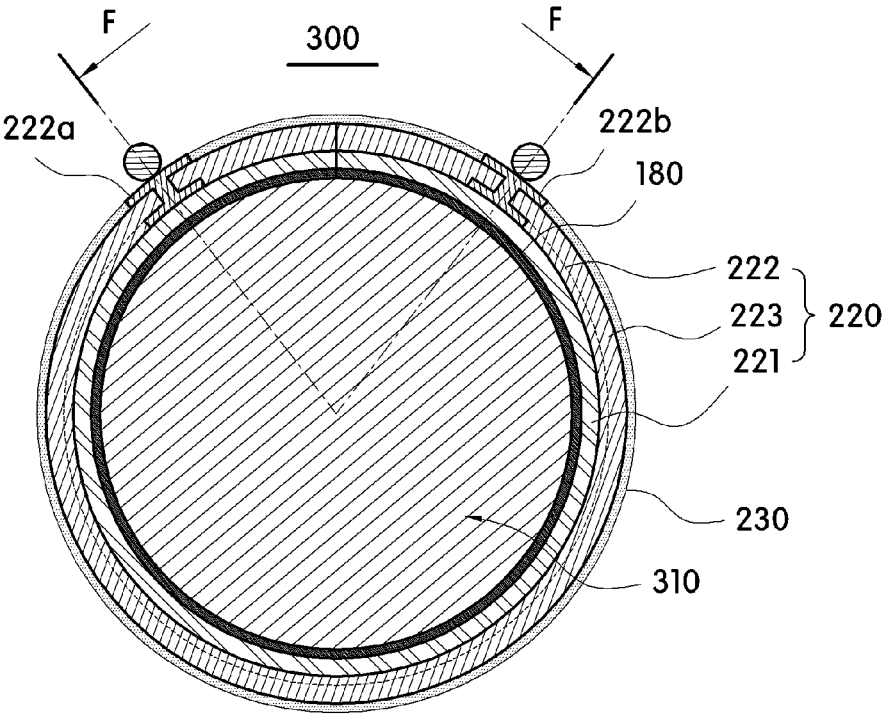
FIG. 16 is a cross-sectional view taken along line E-E of FIG. 15.
Figure 17:
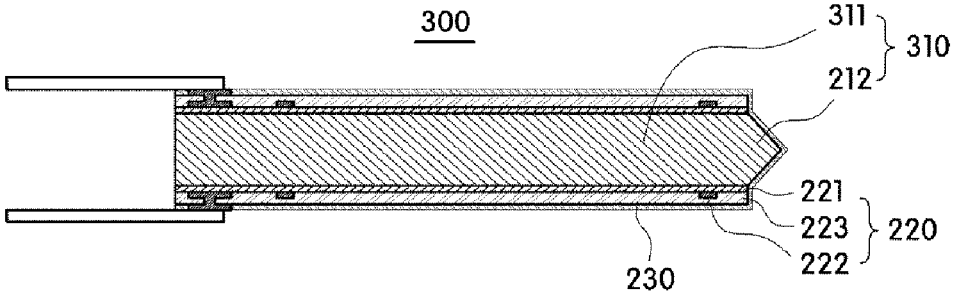
FIG. 17 is a transverse cross-sectional view of FIG. 15 when viewed in a direction of line F-F of FIG. 16.

Meanwhile, as illustrated in FIGS. 12 and 16, in each of the heaters 200 and 300 for a cigarette type electronic cigarette device according to one embodiment of the present invention, a coated heat radiation layer 230 may be formed to increase heat emissivity when the heating portion 220 generates heat. Here, the coated heat radiation layer 230 may be formed on one surface of the heating portion 220 exposed at the outside, and the coated heat radiation layer 230 may be provided to cover both of the heating portion 220 and an exposed surface of the tip portion 212.

Accordingly, since heat generated by the heating portion 220 is smoothly transmitted to the tip portion 212 through the coated heat radiation layer 230 when power is applied thereto, the tip portion 212 may also heat a cigarette 10. Accordingly, each of the heaters 200 and 300 for a cigarette type electronic cigarette device according to the present invention may maximize a heating area because heat generated by the heating portion 220 is transmitted to the tip portion 212.

As an example, the coated heat radiation layer 230 may be a coated layer including a heat radiative filler, and the coated heat radiation layer 230 may be a coated ceramic nano-layer.

Here, the heat radiative filler may be a filler having heat radiation and conduction properties. As a non-restrictive example, the coated heat radiation layer 230 may be a mixture of a carbon-based filler such as a graphite and a carbon nanotube (CNT) and a ceramic filler such as AlN, BN, MgO, and alumina.

The coated heat radiation layer 230 may reduce a temperature deviation between a region straight above the electrode pattern 222 and the remaining region through the heat radiative filler, and a heat radiation property may be improved through the coated heat radiation layer 230. Accordingly, an entire area of each of the heaters 200 and 300 for a cigarette type electronic cigarette device according to the present invention may be uniformly heated or a temperature thereof may be uniformly increased and a temperature thereof may be increased to a high temperature in a short time. That is, a temperature of each of the heaters 200 and 300 for a cigarette type electronic cigarette device on which the coated heat radiation layer 230 is applied may be increased to 300° C. or more in 5 to 15 seconds when power is applied thereto, or may be increased to a heating temperature of 300° C. or more after power is applied thereto for 10 seconds.

This can be seen from the following Table 2.

Table 2 shows heating temperatures according to time in cases in which the coated heat radiation layer 230 is not present on the outer surface of each of the heaters 200 and 300 for a cigarette type electronic cigarette device and the coated heat radiation layer 230 is formed thereon.

TABLE 2

| | Presence of Coated Heat Radiation Layer | |
|---|---|---|
| | X | ○ |
| 0 seconds | 29° C. | 28° C. |
| After 10 seconds | 230 to 270° C. | 304 to 318° C. |
| After 15 seconds | 317 to 346° C. | 376 to 389° C. |
| After 20 seconds | 377 to 409° C. | 439 to 477° C. |

As seen from Table 2, in each of the heaters 200 and 300 for a cigarette type electronic cigarette device according to the embodiment, in the case in which the coated heat radiation layer 230 is formed on the outer surface, a high heating temperature may be realized when compared to the case in which there are no coated heat radiation layers 230. Accordingly, since a temperature of the heater 100 according to one embodiment of the present invention may be increased to a high temperature in a short time, a waiting time for smoking may be decreased. In addition, each of the heaters 200 and 300 for a cigarette type electronic cigarette device according to the embodiment may improve a surface roughness of the heating portion 220 configured to be in direct contact with the cigarette 10 through the coated heat radiation layer 230. Accordingly, since attachment of ash of the cigarette 10 to the heating portion 220 is prevented or minimized, a cleaning operation for removing the ash attached to the heating portion 220 may be minimized, or the heaters 200 and 300 may be reused without performing the cleaning operation.

Figure 19:
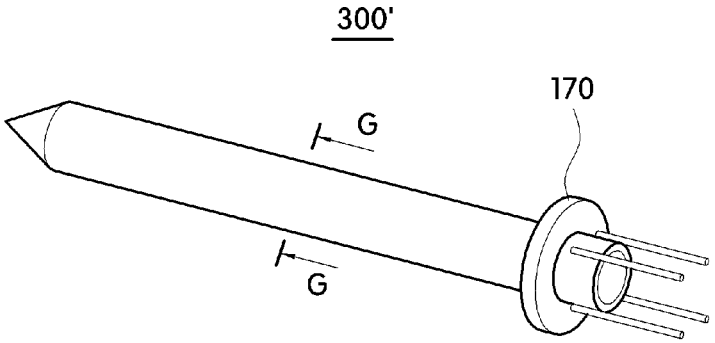
FIG. 19 is a view illustrating a modified example of FIG. 11.
Figure 20:
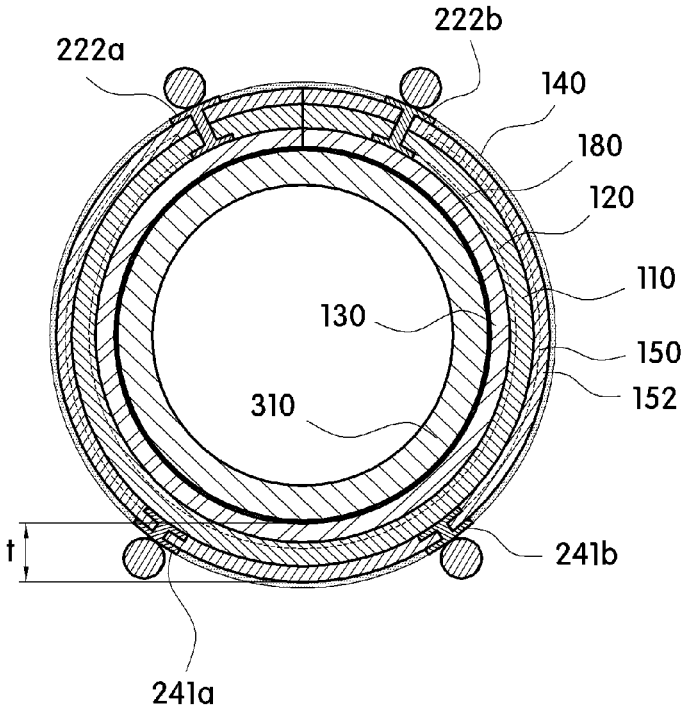
FIG. 20 is a cross-sectional view taken along line G-G of FIG. 12.

Meanwhile, as illustrated in FIG. 19, the heater 200 for a cigarette type electronic cigarette device may include a stopper 170 disposed at a side of one end portion to protrude in a circumferential direction. The stopper 170 may serve as a coupling member or fixing member for coupling each of the heaters 200 and 300 for a cigarette type electronic cigarette device to a cigarette type electronic cigarette device in a process of installing each of the heaters 200 and 300 in the cigarette type electronic cigarette device.

As an example, the stopper 170 may have a ring shape in which a through hole is formed at a center portion thereof, and one end portion of the heater 200 may be inserted into the through hole and may be fixed by a bonding layer.

In this case, the stopper 170 may be disposed to cover the circumferential surface of the heater 200 at a location except for a portion on which the two terminals 121 and 122 and the connecting terminals 151*a* and 151*b* are formed.

That is, in FIG. 19, the pattern portion 222*c* and the pattern portion of the sensor pattern may be disposed at the left of the stopper 170, and the two terminals 222*a* and 222*b* and the connecting terminals 241*a* and 241*b* may be disposed at the right of the stopper 170. Accordingly, in the heater according to the embodiment in FIG. 19, a part of a total length of each of the rod portions 211 and 311 disposed at the left of the stopper 170 may constitute a heating region for heating the cigarette 10.

Here, the stopper 170 may be formed of a ceramic material such as alumina, $ZrO_2$, MgO, $Si_3N_4$, SiC, AlN, or ZTA to improve reliability and increase a life cycle even under an operating condition in which an increase and a decrease in temperature are repeated.

In the drawings, the stopper 170 is be applied to the heater 200 for a cigarette type electronic cigarette device illustrated in FIGS. 11 to 14, but is not limited thereto, and the stopper 170 may also be applied to the heater 300 for a cigarette type electronic cigarette device illustrated in FIGS. 15 to 18.

Although one embodiment of the present invention has been described, the spirit of the present invention is not limited to the described embodiment. Other embodiments may be proposed by those skilled in the art and understanding the spirit of the present invention by adding, modifying, deleting, and supplementing elements within a range of the same spirit, and this also will fall within the scope of the present invention.

The invention claimed is:

1. A heater for a cigarette type electronic cigarette device comprising:

a support body formed of a ceramic material and in a hollow shape to surround a circumferential surface of a cigarette;

an electrode pattern patterned on one surface of the support body to heat the cigarette inserted into the support body when power is applied thereto; and a cover layer having an insulation property and configured to cover the electrode pattern so that the electrode pattern is not exposed, wherein the cover layer is in contact with the circumferential surface of the cigarette.

2. The heater of claim 1, wherein a total thickness of the heater ranges from 0.15 to 0.8 mm.

3. The heater of claim 1, wherein the support body is formed in the hollow shape by sintering a ceramic green sheet after rolling one end portion of the ceramic green sheet having a plate shape to overlap a part of the other end portion thereof.

4. The heater of claim 1, wherein the support body includes a protective layer having a predetermined thickness on the one surface of the support body.

5. The heater of claim 1, further comprising a sensor portion disposed on the one surface of the support body and configured to measure a heating temperature.

6. The heater of claim 5, wherein the sensor portion includes a thin film type temperature sensor patterned on the one surface of the support body constituting a heating portion.

7. The heater of claim 1, further comprising a main body formed of a ceramic material and in a hollow shape having a predetermined length, wherein the support body is disposed to surround the main body in a circumferential direction of the main body.

8. The heater of claim 7, further comprising a stopper provided at a side of one end portion of the heater and formed in the circumferential direction to protrude outward.

9. A heater for a cigarette type electronic cigarette device comprising:

a main body formed of a ceramic material and including one end portion sharply formed to be inserted into a cigarette; and a heating portion disposed to surround a circumferential surface of the main body in a part of a total length of the main body to heat the cigarette, wherein the heating portion includes:

a support body formed of a ceramic material and in a hollow shape;

an electrode pattern patterned on one surface of the support body to generate heat so as to heat the cigarette inserted into the support body; and a cover layer having an insulation property and configured to cover the electrode pattern so that the electrode pattern is not exposed, and wherein the cover layer is in contact with the circumferential surface of the cigarette.

10. The heater of claim 9, wherein the heating portion is formed by sintering the support body after rolling the support body in a ceramic green sheet state to surround the circumferential surface of the main body.

11. The heater of claim 9, wherein at least a part of a total length of the main body is formed in a hollow shape.

12. The heater of claim 9, wherein the main body includes any one among alumina, $ZrO_2$, MgO, $Si_3N_4$, SiC, and AlN.

13. The heater of claim 9, wherein the main body is formed in a solid type.

14. The heater of claim 13, wherein the main body includes a ceramic material having a thermal conductivity of 30 W/m·K or more.

15. The heater of claim 9, wherein the main body includes a ceramic material of which a temperature increases to 200° C. or more when power is applied thereto for ten seconds.

16. The heater of claim 9, further comprising a coated heat radiation layer having a high heat resistance property and applied on an exposed surface of the heater to have a predetermined thickness.

17. The heater of claim 9, further comprising a sensor portion interposed between the main body and the heating portion and configured to measure a heating temperature of the heating portion.

18. The heater of claim 17, wherein the sensor portion includes a thin film type temperature sensor patterned on one surface of a support body constituting the heating portion.

19. The heater of claim 9, further comprising a stopper provided at a side of one end portion of the heater and formed in a circumferential direction thereof to protrude outward.

* * * * *